US010173344B2

(12) United States Patent
Wung

(10) Patent No.: US 10,173,344 B2
(45) Date of Patent: Jan. 8, 2019

(54) TILE CUTTER WITH COLLAPSIBLE CUTTING HEAD ASSEMBLY

(71) Applicant: REXON INDUSTRIAL CORP., LTD., Taichung (TW)

(72) Inventor: Chun Ti Wung, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 49 days.

(21) Appl. No.: 15/368,734

(22) Filed: Dec. 5, 2016

(65) Prior Publication Data

US 2017/0157797 A1 Jun. 8, 2017

(30) Foreign Application Priority Data

Dec. 8, 2015 (TW) ..... 104141123 A

(51) Int. Cl.
*B28D 1/04* (2006.01)

(52) U.S. Cl.
CPC ..... *B28D 1/042* (2013.01); *B28D 1/047* (2013.01)

(58) Field of Classification Search
CPC ..... B28D 1/042; B28D 1/047; B28D 1/04
USPC ..... 125/13.01, 13.03, 14, 35; 451/450
See application file for complete search history.

(56) References Cited

U.S. PATENT DOCUMENTS 1,703,179 A * 2/1929 Skolnik ..... B27B 5/207 144/119.1
3,340,863 A * 9/1967 Zuzelo ..... B28D 1/042 125/14
5,746,193 A * 5/1998 Swan ..... B28D 1/042 125/13.03
6,752,140 B1 * 6/2004 Fuhrman ..... B23D 45/02 125/13.01
7,140,361 B1 * 11/2006 Chao-Huan ..... B23D 45/024 125/13.01
2004/0211307 A1 * 10/2004 Lee ..... B23D 45/02 83/581
2006/0266189 A1 * 11/2006 Chen ..... B23D 45/024 83/581

* cited by examiner

*Primary Examiner* — Robert Rose
(74) *Attorney, Agent, or Firm* — Bacon & Thomas, PLLC

(57) ABSTRACT

A tile cutter includes a base, and a cutting head assembly including a supporting arm having one end pivotally connected to the base and an opposite end connected to the saw base for enabling the cutting head assembly to be biased relative to the base and selectively positioned in a standby position, a cutting position or a received position. When shifting the cutting head assembly from the standby position to the cutting position, the supporting arm is received by a stopper to limit the cutting depth of the cutting head assembly. When shifting the cutting head assembly from the cutting position to the received position, the stopper is moved to release the supporting arm. When the cutting head assembly is shifted to the received position, a part of the saw base and the saw blade are received in a sink in the base.

4 Claims, 9 Drawing Sheets

TILE CUTTER WITH COLLAPSIBLE CUTTING HEAD ASSEMBLY

BACKGROUND OF THE INVENTION

1. Field of the Invention

The present invention relates to tile cutting technology and more particularly, to a tile cutter with a collapsible cutting head assembly.

2. Description of the Related Art

Since tiles are hard and brittle, a regular cutting tool cannot be used for cutting tiles. Therefore, when cutting a tile, a specially designed tile cutter should be used. Various tile cutters are known. In conventional tile cutter designs, the cutting head assembly is not movable. Thus, in operation, the user needs to move a sliding worktable to carry the tile toward the cutting head assembly to enable the tile to be cut into the desired size by the cutting head assembly. After the cutting operation, due to fixed design, the cutting head assembly is not collapsible to reduce the volume and space of the tile cutter. Therefore, conventional tile cutters commonly occupy a large amount of storage space.

SUMMARY OF THE INVENTION

The present invention has been developed in view of the above circumstances. It is one of the main objects of the present invention to provide a tile cutter, which has a storage function and can reduce the volume for storage when not used.

To achieve this and other objects of the present invention, a tile cutter comprises a base, a worktable, a cutting head assembly, and a stopper. The base comprises a sink. The worktable is slidably mounted on the base above the sink. The cutting head assembly comprises a saw base, a saw blade and a supporting arm. The saw blade is pivotally mounted at the saw base. The supporting arm has one end thereof pivotally connected to the base, and an opposite end thereof connected to the saw base. Thus, the cutting head assembly can be biasable among a standby position, a cutting position, and a received position where a part of the saw base and the saw blade are received in the sink of the base. The stopper is connected to the base, and movable between a stoppage position and a release position.

The cutting head assembly can be moved downwardly from the standby position to the cutting position, by moving the stopper to the stoppage position for enabling the stopper to receive the supporting arm so as to limit the cutting depth of the saw blade. Further, the cutting head assembly can be moved downwardly from the cutting position to the received position, by moving the stopper to the release position to release the supporting arm from the constraint. After the cutting head assembly reaches the received position, a part of the saw base and the saw blade are received in the sink of the base, completing the storage.

Preferably, the tile cutter further comprises a locking device. The locking device comprises a barrel fixedly connected with one end thereof to a bracket at the base, and a locking bolt axially movably inserted through the barrel. When the cutting head assembly is set in the received position, the locking bolt is forced to engage the end piece thereof by being inserted into a locating hole of the supporting arm to lock the cutting head assembly in the received position.

Other and further advantages and features of the present invention will be understood by reference to the following specification in conjunction with the accompanying drawings.

DETAILED DESCRIPTION OF THE INVENTION

Figure 1:
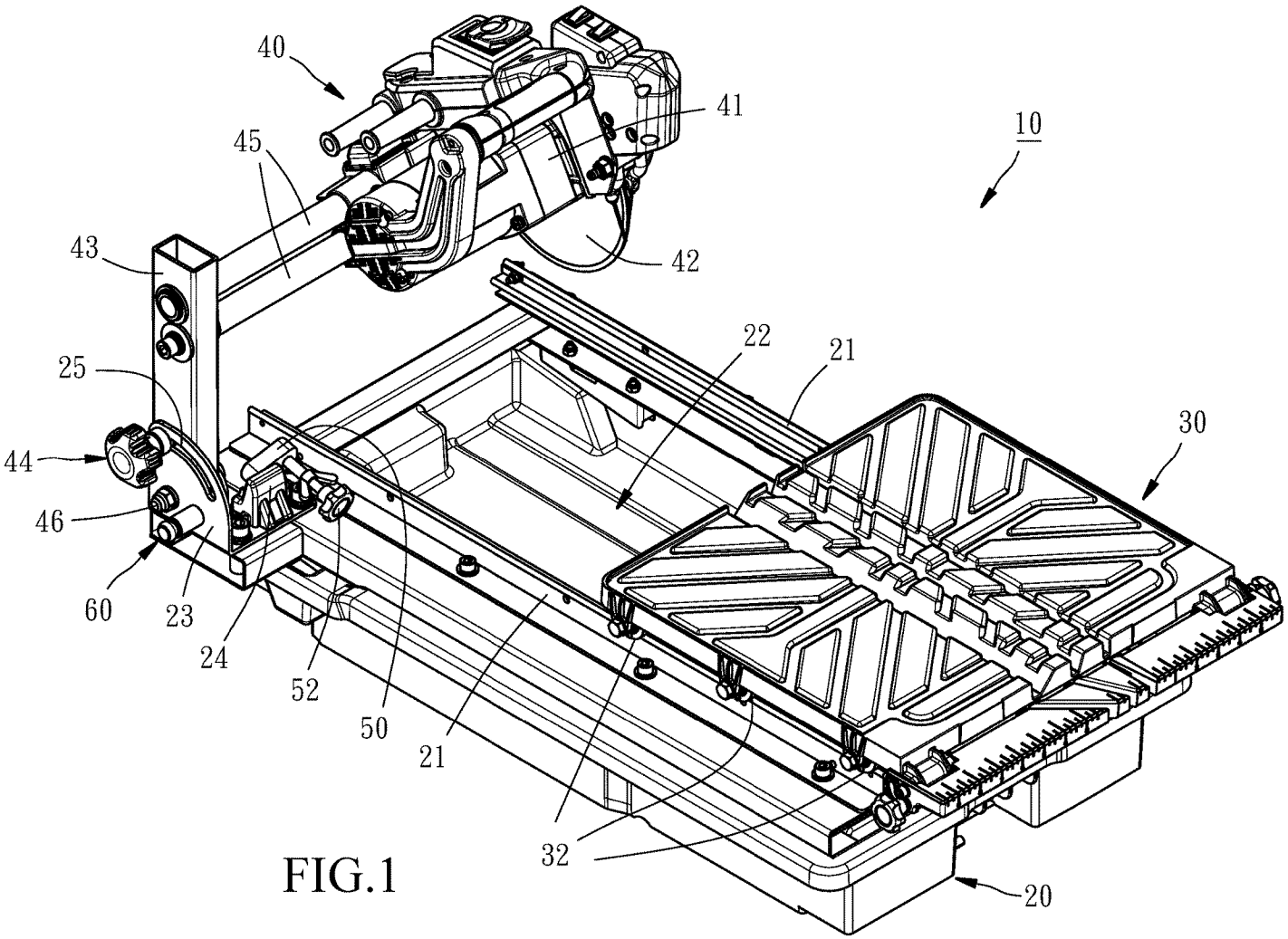
FIG. 1 is an oblique top elevational view of a tile cutter in accordance with the present invention, illustrating a cutting head assembly of the tile cutter in a standby position.

Referring to FIG. 1, a tile cutter 10 in accordance with the present invention is shown. The tile cutter 10 comprises a base 20, a worktable 30, a cutting head assembly 40, a stopper 50, and a locking device 60.

The base 20 is mountable on a tabletop, comprising two rails 21 arranged in parallel, a sink 22 defined between the two rails 21, a bracket 23 located at one lateral side thereof, and a locating block 24 abutted to one side of the bracket 23. The bracket 23 defines therein an arched sliding slot 25.

The worktable 30 is disposed above the sink 22 of the base 20, comprising a plurality of rollers 32 bilaterally and symmetrically arranged at a bottom wall thereof and respectively slidably coupled to the rails 21 of the base 20. Thus, the worktable 30 is movable horizontally relative to the base 20.

The cutting head assembly 40 comprises a saw base 41, a saw blade 42, a supporting arm 43, and a guide member 44. The saw blade 42 is mounted at the saw base 41. The saw base 41 is connected to the top end of the supporting arm 43 with two parallel transverse rods 45. The supporting arm 43 has the opposing bottom end thereof pivotally connected to the bracket 23 of the base 20 with a pivot axle 46 so that the cutting head assembly 40 can be biased up and down among a standby position P1 (see FIG. 2), a cutting position P2 (see FIG. 4), and a received position P3 (see FIG. 7 and FIG. 8). Further, the supporting arm 43 has a locating hole 47 located on the bottom end thereof (see FIG. 2). The guide member 44 is inserted through the arched sliding slot 25 of the base 20, and connected with a tail end thereof to the bottom end of the supporting arm 43. Thus, when biasing the cutting head assembly 40 relative to the base 20, the guide member 44 is moved along the arched sliding slot 25 of the base 20 to guide the biasing motion of the cutting head assembly 40 and to enhance its biasing stability. The guide member 44 can be a bolt having a star-shaped head or other shaped knob to facilitate the movement of the guide member 44 along the arched sliding slot 25. It is also appreciated that the guide member 44 can include a threaded end that is received in a hole in the supporting arm 43 to allow an adjustment of the guide member 44 to frictionally engage the arched sliding slot 25 to further secure the supporting arm 43.

Figure 3:
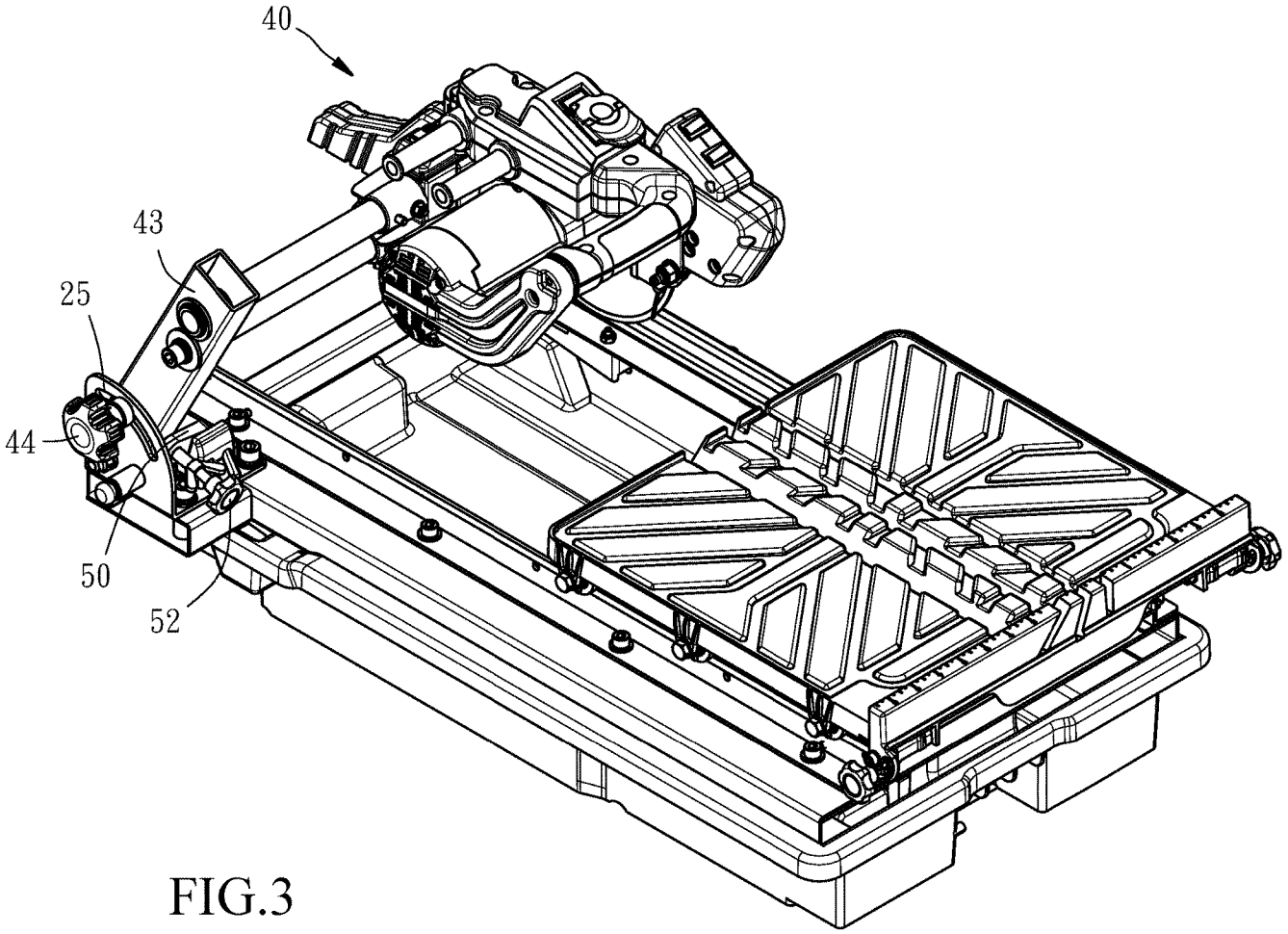
FIG. 3 is similar to FIG. 1, illustrating the cutting head assembly in the cutting position.
Figure 4:
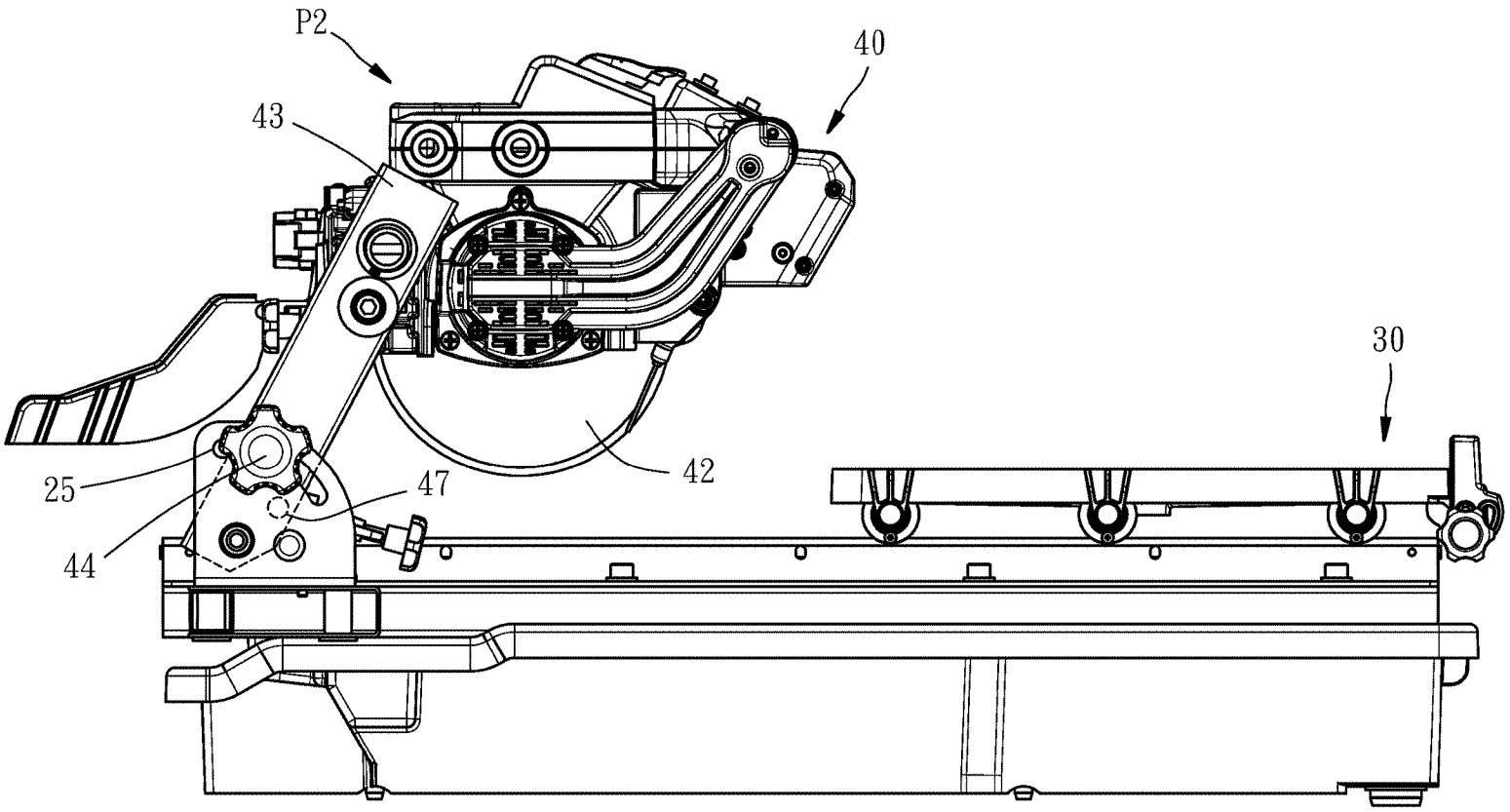
FIG. 4 is a front view of FIG. 3.

As illustrated in FIG. 1, the stopper 50 has one end thereof pivotally connected to the locating block 24 of the base 20, and an opposite end thereof connected with a lever 52. By means of operating the lever 52, the stopper 50 can be biased between a stoppage position P4 (see FIG. 5) and a release position P5 (see FIG. 6). When the stopper 50 is moved to the stoppage position P4 shown in FIG. 5, the stopper 50 receives the supporting arm 43 of the cutting head assembly 40 (see FIG. 3) to hold the cutting head assembly 40 in the cutting position P2, as shown in FIG. 4. On the contrary, when the stopper 50 is moved to the release position P5 shown in FIG. 6, the stopper 50 is kept away from the supporting arm 43 of the cutting head assembly 40, allowing the cutting head assembly 40 to be biased between the cutting position P2 shown in FIG. 4 and the received position P3 shown in FIG. 8. It is appreciated that the lever can be operated in a number of ways, for example, manually to bias the stopper between positions, the lever 52 can include a spring and locating hole for locking the stopper in the positions, and/or can include an elastic member for biasing the stopper in one of the release position or the cutting position.

Figure 5:
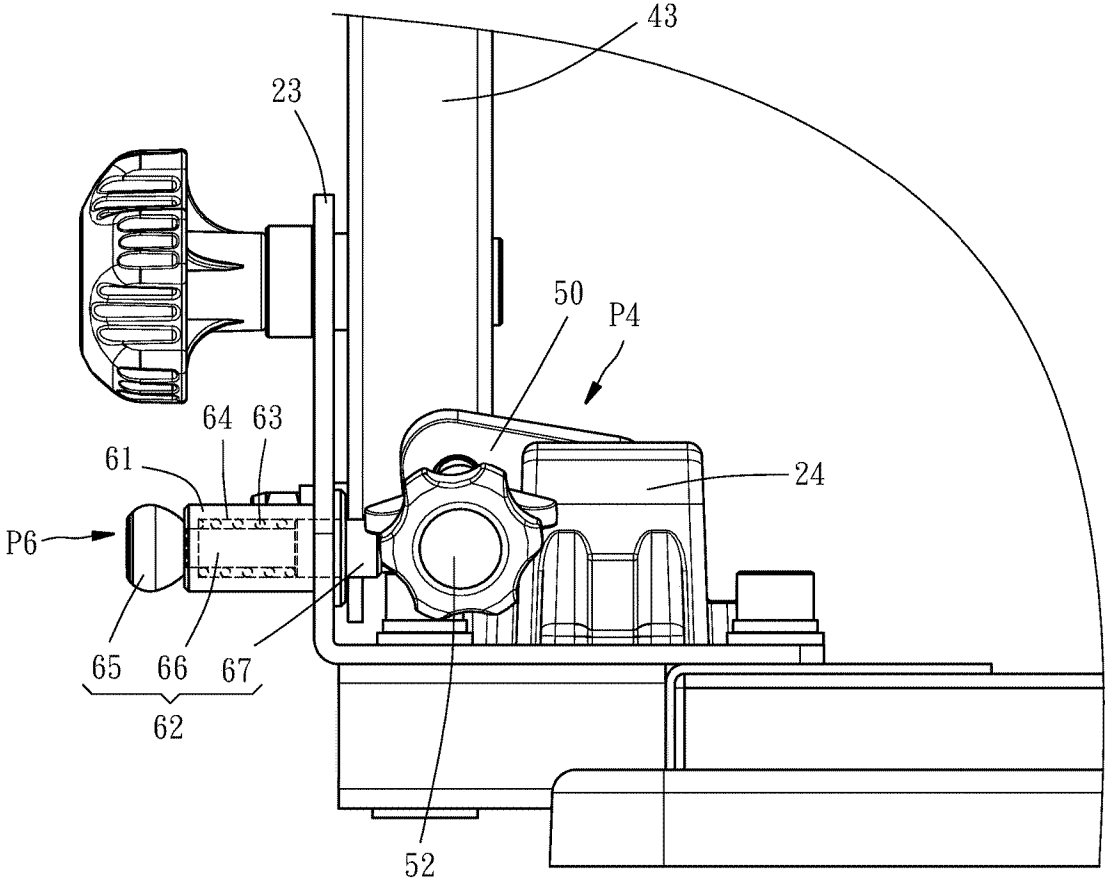
FIG. 5 is a sectional side view of a part of the present invention, illustrating the stopper in the stoppage position and the locking bolt in the locking position.
Figure 6:
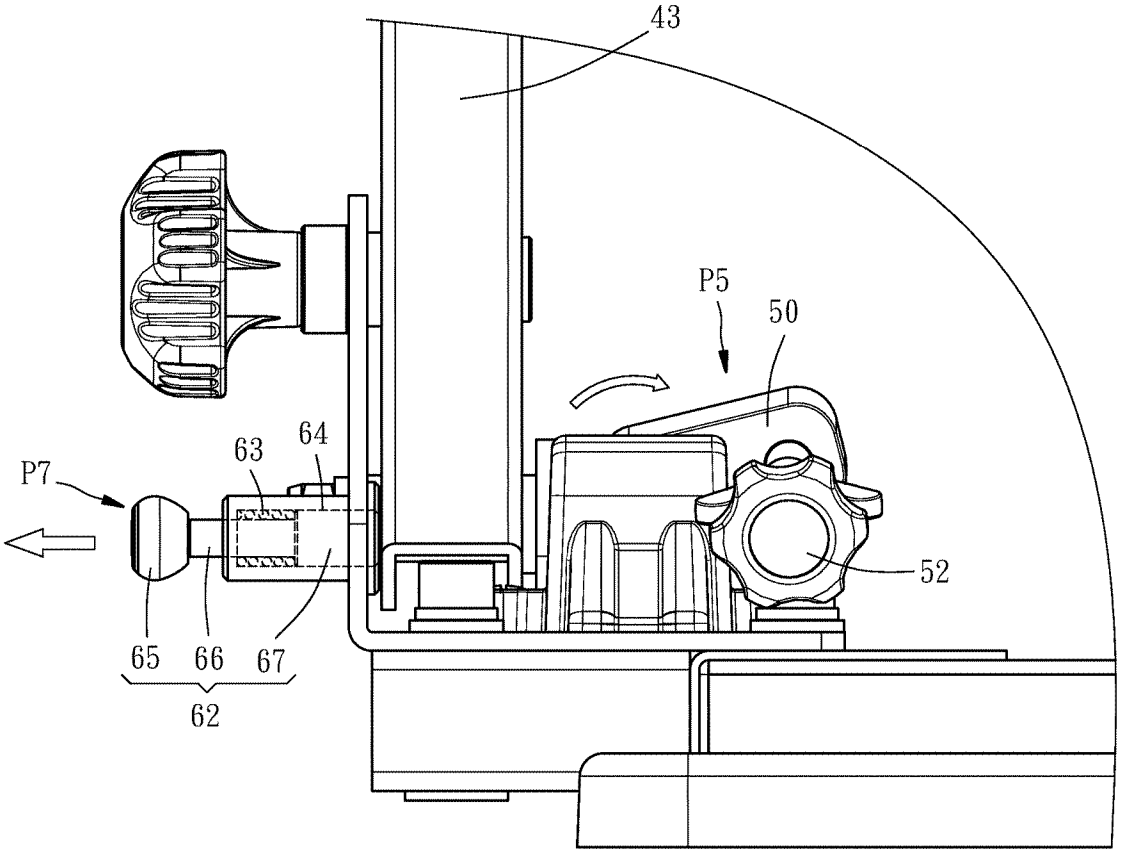
FIG. 6 is similar to FIG. 5, illustrating the stopper in the release position and the locking bolt in the unlocking position.

As illustrated in FIGS. 5 and 6, the locking device 60 comprises a barrel 61, a locking bolt 62, and an elastic member 63, e.g., a spring. The barrel 61 has one end thereof fixedly connected to the bracket 23 of the base 20, and an opposite end thereof provided with a bolt hole 64. The locking bolt 62 comprises a head 65, an end piece 67, and a shank 66 connected between the head 65 and the end piece 67. The head 65 of the locking bolt 62 is disposed outside the barrel 61. The shank 66 of the locking bolt 62 is positioned in the bolt hole 64 of the barrel 61. The locking bolt 62 is movable between a locking position P6 (see FIG. 5) and an unlocking position P7 (see FIG. 6). When the locking bolt 62 is moved to the locking position P6, as shown in FIG. 5, the end piece 67 of the locking bolt 62 is partially extended out of the barrel 61. On the contrary, when the locking bolt 62 is moved to the unlocking position P7, as shown in FIG. 6, the end piece 67 of the locking bolt 62 is completely received inside the barrel 61. The elastic member 63 is sleeved onto the shank 66 of the locking bolt 62 and stopped between the end piece 67 of the locking bolt 62 and an end wall of the bolt hole 64 to hold the locking bolt 62 in the locking position P6.

Figure 2:
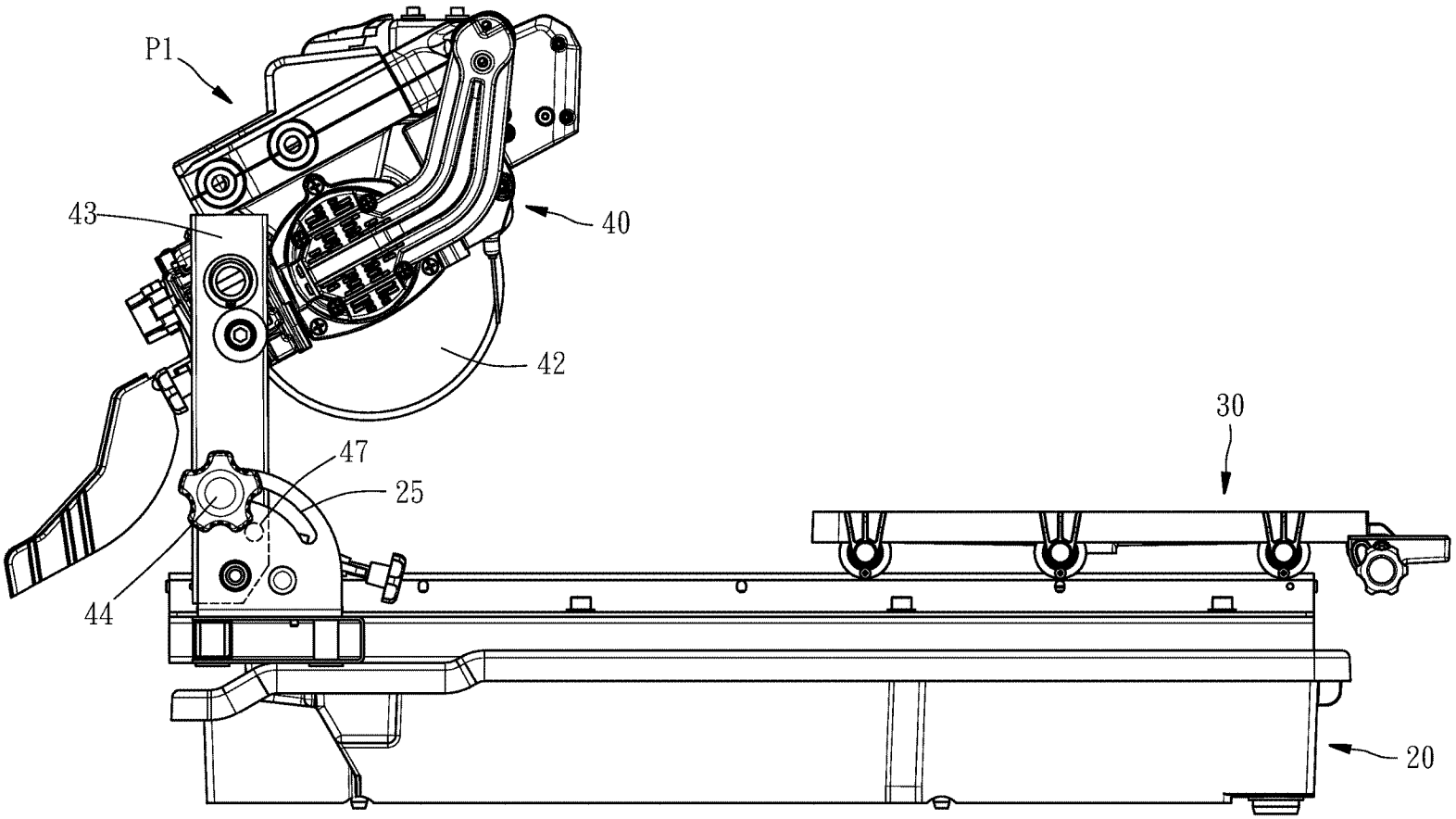
FIG. 2 is a front view of the tile cutter in accordance with the present invention.

Thus, when the user is going to move the cutting head assembly 40 downwardly from the standby position P1 shown in FIG. 2 to the cutting position P2 shown in FIG. 4, the lever 52 is operated to move the stopper 50 to the stoppage position P4 shown in FIG. 5, and then the cutting head assembly 40 is pressed downwardly to the cutting position P2 shown in FIG. 4, enabling the stopper 50 to bear the supporting arm 43 so as to limit the cutting depth of the saw blade 42. At this time, the user can operate the tile cutter 10 to cut the workpiece on the worktable 30.

Figure 7:
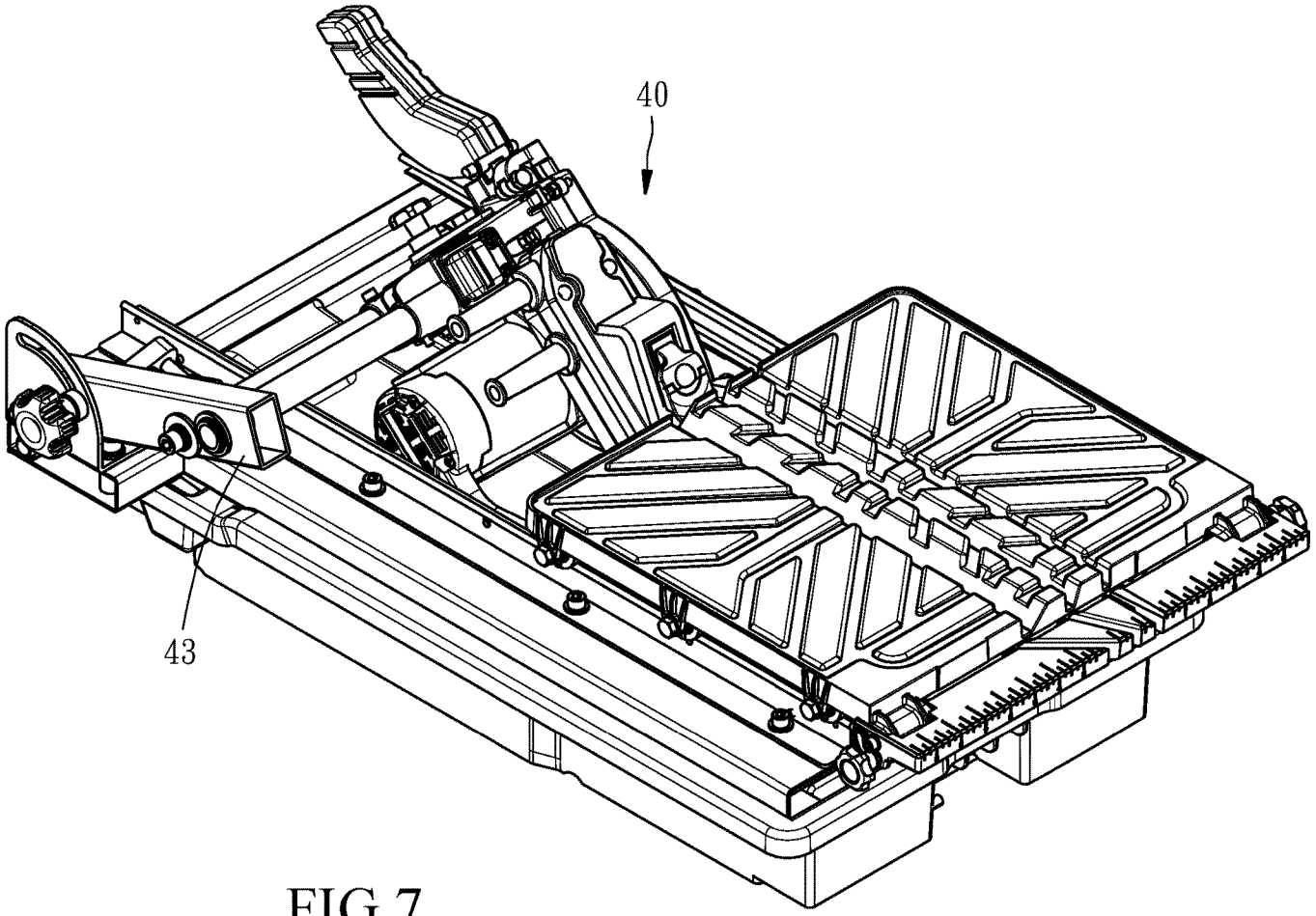
FIG. 7 is similar to FIG. 1, illustrating the cutting head assembly in the received position.
Figure 8:
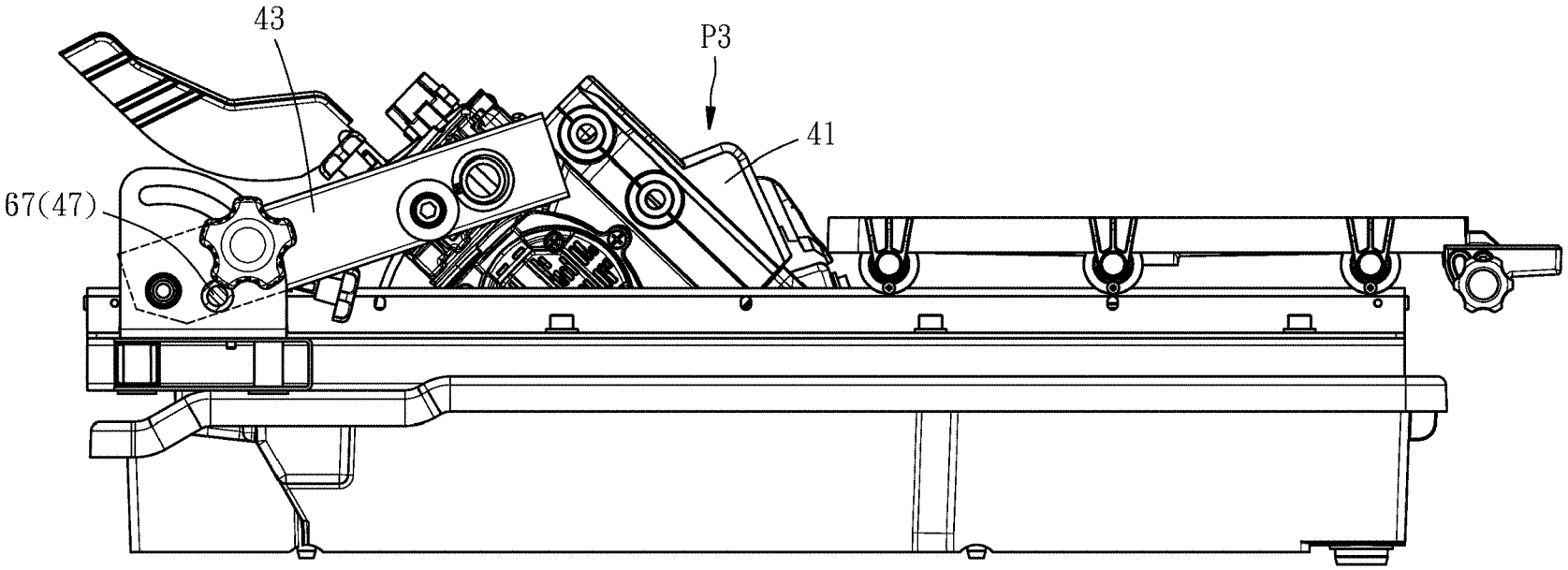
FIG. 8 is a front view of FIG. 7.

When the user changes positions to receive the tile cutter 10 after a cutting operation, the lever 52 is operated to move the stopper 50 to the release position P5 shown in FIG. 6, and then the head 65 of the locking bolt 62 is pulled to move the locking bolt 62 to the unlocking position P7 shown in FIG. 6. At this time, the cutting head assembly 40 is moved downwardly to the received position P3 shown in FIG. 8. After the cutting head assembly 40 reaches the received position P3, as shown in FIG. 7 and FIG. 8, a part of the saw base 41 and the saw blade 42 are received in the sink 22 of the base 20. Thereafter, the locking bolt 62 is released, enabling the locking bolt 62 to be forced by the elastic member 63 so that the end piece 67 of the locking bolt 62 is engaged into the locating hole 47 of the supporting arm 43, as shown in FIG. 8, and thus, the cutting head assembly 40 is locked in the received position.

Figure 9:
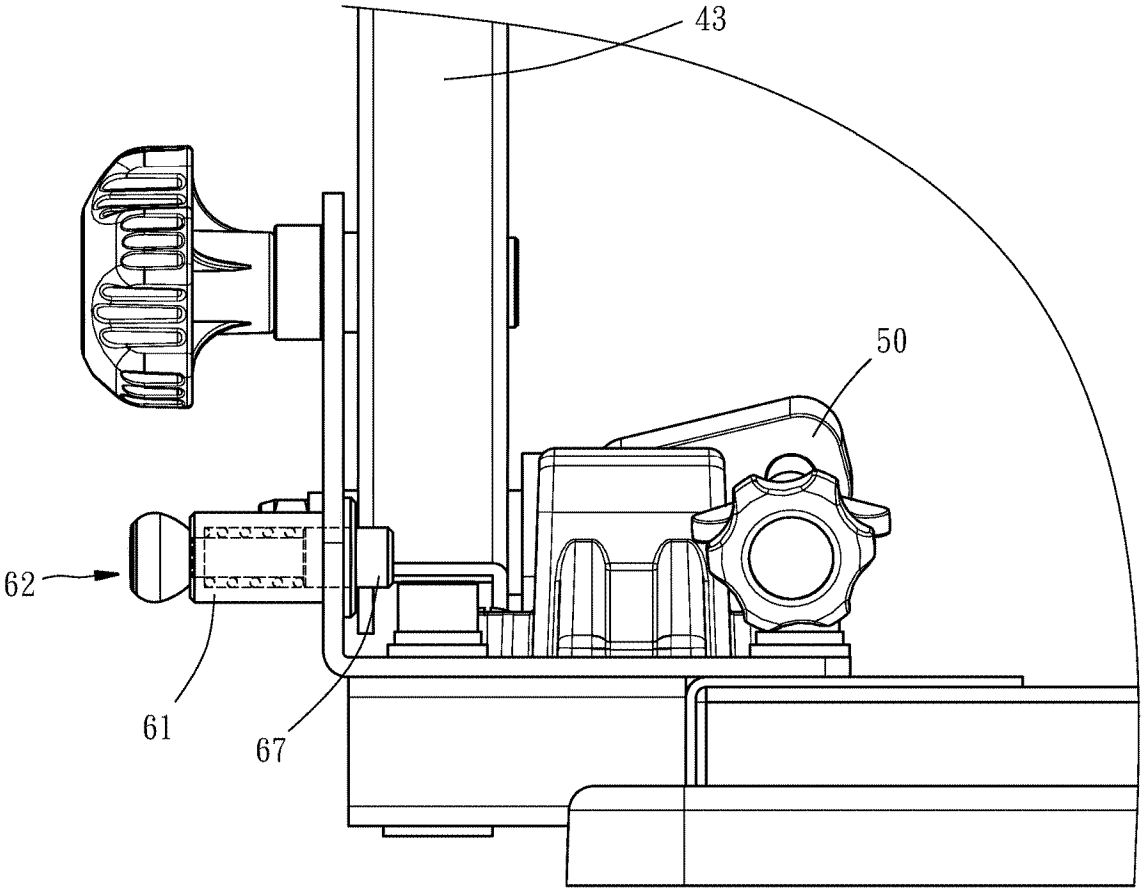
FIG. 9 is similar to FIG. 5*f*, illustrating the stopper in the release position and the locking bolt in the locking position.

On the other hand, if the user forgets to shift the stopper 50 to the stoppage position P4 and moves the cutting head assembly 40 from the standby position P1 to the cutting position P2, as shown in FIG. 9, the end piece 67 of the locking bolt 62 is constantly maintained to protrude out of the barrel 61 due to the effect of the elastic member 62. Thus, after the cutting head assembly 40 reaches the cutting position P2, the supporting arm 43 will interfere with the end piece 67 of the locking bolt 62, reminding the user that the stopper 50 has not yet been shifted to the correct position to effectively prevent the occurrence of a dangerous cutting action.

In conclusion, the tile cutter 10 of the present invention can limit the cutting depth of the saw blade 42 to an appropriate range during operation, and enables the saw blade 42 and a part of the saw base 41 to be received in the sink 22 of the base 20 after a cutting operation, achieving the effects of volume reduction and space saving.

What is claimed is:

1. A tile cutter, comprising:

a base comprising a sink;

a worktable movably mounted on said base above said sink;

a cutting head assembly comprising a saw base, a saw blade pivotally mounted to said saw base and a supporting arm, said supporting arm having one end thereof pivotally connected to said base and an opposite end thereof connected to said saw base so that said cutting head assembly is biasable between a standby position, a cutting position, and a received position where a part of said saw base and said saw blade are received in said sink of said base; and a stopper connected to said base and movable between a stoppage position where said stopper receives said supporting arm of said cutting head assembly to hold said cutting head assembly in said cutting position and a release position where said stopper is kept away from said supporting arm for allowing said cutting head assembly to be biased between said cutting position and said received position, wherein said base comprises a bracket, said bracket comprising an arched sliding slot; said cutting head assembly further comprising a guide member inserted through said arched sliding slot of said bracket and connected to said supporting arm and movable along said arched sliding slot; and said supporting arm having a bottom end thereof pivotally connected to said bracket of said base.

2. A tile cutter, comprising:

a base comprising a sink;

a worktable movably mounted on said base above said sink;

a cutting head assembly comprising a saw base, a saw blade pivotally mounted to said saw base and a supporting arm, said supporting arm having one end thereof pivotally connected to said base and an opposite end thereof connected to said saw base so that said cutting head assembly is biasable between a standby position, a cutting position, and a received position where a part of said saw base and said saw blade are received in said sink of said base; and a stopper connected to said base and movable between a stoppage position where said stopper receives said supporting arm of said cutting head assembly to hold said cutting head assembly in said cutting position and a release position where said stopper is kept away from said supporting arm for allowing said cutting head assembly to be biased between said cutting position and said received position, wherein said base comprises a bracket; said supporting arm having a bottom end thereof pivotally connected to said bracket of said base and provided with a locating hole; said tile cutter further comprising a locking device, said locking device comprising a barrel fixedly connected with one end thereof to said bracket of said base and a locking bolt inserted through said barrel and detachably engaged into said locating hole of said supporting arm to lock or unlock said cutting head assembly in said received position.

3. The tile cutter as claimed in claim 2, wherein said barrel comprises a bolt hole; said locking bolt comprises a head disposed outside said bolt hole of said barrel, a shank extended from said head and disposed in said bolt hole of said barrel, and an end piece located at a distal end of said shank opposite to said head and partially extendable out of said bolt hole of said barrel; said locking device further comprises an elastic member mounted around said shank of said locking bolt and stopped between said end piece of said locking bolt and an end wall of said bolt hole for biasing said end piece to be extended out of said bolt hole.

4. A tile cutter, comprising:

a base comprising a sink;

a worktable movably mounted on said base above said sink;

a cutting head assembly comprising a saw base, a saw blade pivotally mounted to said saw base and a supporting arm, said supporting arm having one end thereof pivotally connected to said base and an opposite end thereof connected to said saw base so that said cutting head assembly is biasable between a standby position, a cutting position, and a received position where a part of said saw base and said saw blade are received in said sink of said base; and a stopper connected to said base and movable between a stoppage position where said stopper receives said supporting arm of said cutting head assembly to hold said cutting head assembly in said cutting position and a release position where said stopper is kept away from said supporting arm for allowing said cutting head assembly to be biased between said cutting position and said received position, wherein said base comprises a bracket, and a locating block fixedly located at said bracket; said supporting arm has a bottom end thereof pivotally connected to said bracket of said base; said stopper has one end thereof pivotally connected to said locating block, and an opposite end thereof provided with a lever that is biasable to move said stopper between said stoppage position and said release position.

* * * * *